United States Patent [19]

Kurkowski et al.

[11] Patent Number: 4,852,327

[45] Date of Patent: Aug. 1, 1989

[54] MACHINE FOR ASSEMBLING A CONTAINER

[75] Inventors: Frank Kurkowski, Messenkamp; Manfred Lucht, Rodenberg, both of Fed. Rep. of Germany

[73] Assignee: Philips and DuPont Optical Company, New York, N.Y.

[21] Appl. No.: 133,678

[22] Filed: Dec. 16, 1987

[30] Foreign Application Priority Data

Dec. 20, 1986 [DE] Fed. Rep. of Germany ..... 3643693

[51] Int. Cl.[4] ..... B65B 25/24; B65B 5/04

[52] U.S. Cl. ..... 53/201; 53/238; 53/254; 29/453; 29/773; 29/785; 29/793

[58] Field of Search ..... 53/254, 238, 201, 240, 53/249, 250, 267, 276, 377, 266 R; 29/453, 283, 773, 785, 793, 806; 269/287, 47, 50, 57, 58

[56] References Cited

U.S. PATENT DOCUMENTS 4,144,637 3/1979 Ioffe et al. ..... 29/785 X 4,551,966 11/1985 Aoyagi et al. ..... 53/254 X 4,685,277 8/1987 Ilsemann ..... 53/238 X

*Primary Examiner*—Horace M. Culver

[57] ABSTRACT

The invention relates to a machine comprising an apparatus for assembling a container for an optically readable disc-shaped information carrier. The container comprises a bottom section, a cover section, a bottom insertion-card, a cover leaflet, and a tray. The disc-shaped information carrier is detachably retained in the tray. During assembly the bottom section serves as an assembly base. In order to load the disc-shaped information carrier into a tray without the remainder of the container, the machine is provided with an auxiliary bottom section which is secured to the apparatus and in principle has the same dimensions as a container bottom section, so that a tray can be placed in the auxiliary bottom section and after it has been loaded with a disc-shaped information tray, can be removed as a unit from the auxiliary bottom section.

4 Claims, 1 Drawing Sheet

MACHINE FOR ASSEMBLING A CONTAINER

Figure 1:
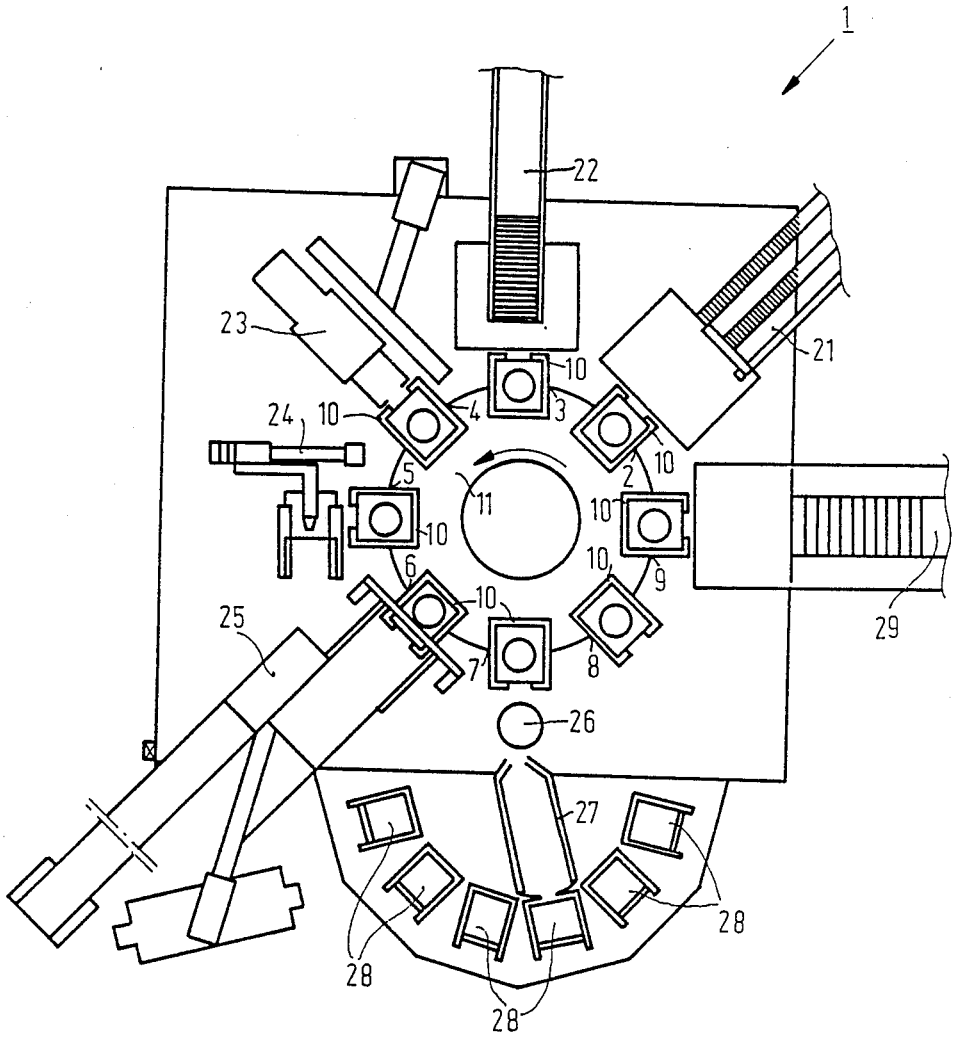

The invention relates to a machine comprising an apparatus for assembling a container for an optically readable disc-shaped information carrier, which container comprises a bottom section and a cover section which is pivotally attached to said bottom section, a bottom insert-card, and a tray which is adapted to be placed in the bottom section on the bottom insert-card and to detachably retain the disc-shaped information carrier, the bottom section serving as an assembly base and, while retained in a holder, being moved from station to station by the machine during assembly.

Such machines are known in various versions, for assembling containers for optically readable digital audio discs (Compact Discs). The disc containers are assembled step-by-step at several stations of the machine.

At a first station of a known machine of such a type the bottom of the container is placed on a holder of the machine and is retained therein. A cover section is pivotally attached to the bottom section. Together the bottom section and the cover section constitute a box-shaped container. During further assembly steps the bottom section serves as an assembly base and is transferred from station to station by the machine. At the second station an insert card in inserted into the bottom section, which card can be read from the exterior of the container through the transparent bottom section and provides information about, for example, the program on the disc. At a third station a cover leaflet, which leaflet also contains information about the programme on the disc, may be inserted into the cover section. After the cover section has been swung up at a further station a tray is inserted into the bottom section at a fourth station. This tray comprises lateral latching noses which are adapted to engage in corresponding recesses in the side walls of the bottom section, to secure the tray in the bottom section. Subsequently, at a further station the disc-shaped information carrier is placed in the tray and is detachably retained in the tray. For this purpose the tray comprises, for example, a central peg-shaped holder onto which the disk is clamped. After a further station, where the cover is closed, the assembled container reaches a last station where it can be removed from the machine.

Such a machine is constructed to enable a complete container for a disc-shaped information carrier comprising a bottom section, a bottom insert -card, a cover section, a cover leaflet, and a tray to be assembled and a disc-shaped information carrier to be inserted into the tray.

However, such a machine comprising an apparatus, for assembling a container for optically readable disc-shaped information carriers is only constructed to assemble a complete container in the manner described above. However, for deliveries to third parties and also for storage purposes it may be desirable that the container is not assembled completely but that merely the tray is provided with a disc-shaped information carrier. This is the case, for example, for storage purposes or for deliveries to third parties wishing to carry out packaging, including insertion of the insert cards, themselves.

It is the object of the invention to provide a machine of the type defined in the opening paragraph and comprising an apparatus for assembling a container, which solely enables the tray to be provided with a disc-shaped information carrier and said information carrier to be detachably retained in the tray.

According to the invention this object is achieved in that for solely loading the disc-shaped information carrier into the tray the holders are provided with auxiliary bottom sections which have substantially the same dimensions as a container bottom section and which are arranged on the holders in such a way that the trays can be placed in the auxiliary bottom sections and can be removed from the auxiliary bottom sections after insertion of a disc-shaped information carrier.

The holders of the machine, which are originally constructed to receive the bottom section only, are now provided with auxiliary bottom sections. This may be effected, for example, by means of screws , so that the auxiliary bottom sections are detachable. The auxiliary bottom sections have, in principle, the same dimensions as a normal container bottom section, so that they can receive the trays, which are immobilized in the auxiliary bottom sections. However, the trays are not clamped in the auxiliary bottom sections, so that they are removable in an upward direction. To provide a tray with a disc-shaped information carrier the machine operates in the same way. The tray is placed in the auxiliary bottom section, subsequently, at a further station, the tray is loaded with a disc-shaped information carrier so as to be detachable from said tray, and at a last station the tray thus loaded can be removed from the auxiliary bottom section. As the tray is merely placed in the auxiliary bottom section but is not fixedly connected thereto, for example by latching means, the tray is easy to remove from the auxiliary bottom section.

In this way a machine equipped with apparatus for assembling a complete container for disc-shaped information carriers may also be used for merely loading trays with disc-shaped information carriers. Thus , the machine can be adapted to assemble both types of packages in a comparatively short conversion time. For this purpose it is not necessary to modify the machine control, because the first stations, at which normally handle the bottom sections, the cover sections and the leaflets, are now idle. Moreover, the positioning to handle the tray and the disc-shaped information carrier remains the same, because the trays are positioned in the auxiliary bottom section in exactly the same way as in the normal container bottom section. Such a machine comprising an assembly apparatus is therefore very universal, so that it operates economically, even if some stations of the machine are not needed and idle in one mode of operation. In addition, such machines operate at a very high speed and generally they are not permanently operative, so that an additional possibility of using them already leads to an increased efficiency.

In a further embodiment of the invention the side walls of the auxiliary bottom sections have recesses which open towards the loading side at those locations where a container bottom section is formed with bores in which latching noses of a tray to be inserted are engageable.

The trays comprise latching noses which normally serve to engage in open recesses in the standard container bottom sections. These recesses are formed in the side walls of the bottom sections. The auxiliary bottom sections, which for the remainder have substantially the same dimensions as a container bottom section, are provided with recesses which open towards the loading side at those locations of the side walls, where the trays are provided with latching noses at the corresponding locations. This ensures that the tray is easy to remove from the auxiliary bottom section in the machine.

In a further embodiment of the invention each auxiliary bottom section has an opening in the bottom and in at least one side wall, which opening is dimensioned to enable a tray placed in the auxiliary bottom section to be gripped and removed by a manipulator which normally removes the entire container including its bottom section after assembly. Thus, without any modification to the machine or the apparatus of said machine, the manipulator can be used for gripping and removing solely the tray placed in the auxiliary bottom section. The recesses must be formed in the auxiliary bottom sections in such a way that depending on the machine the manipulator only grips a tray present in the auxiliary bottom section.

An embodiment of the invention will now be described in more detail, by way of example, with reference to the drawings.

Figure 2:
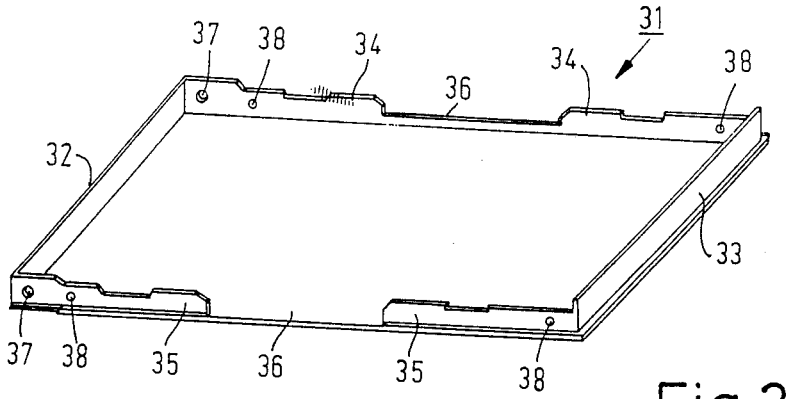
Figure 3:
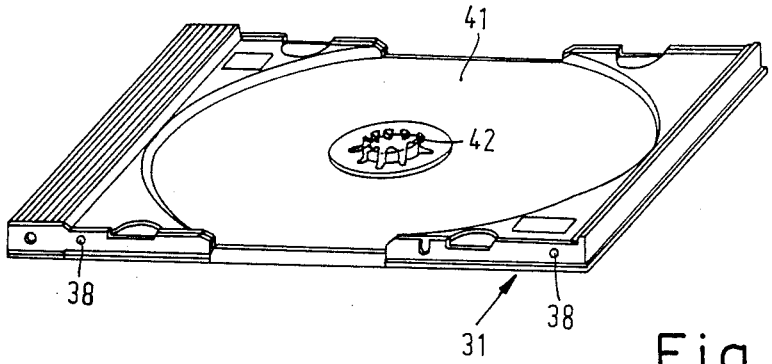
Figure 4:
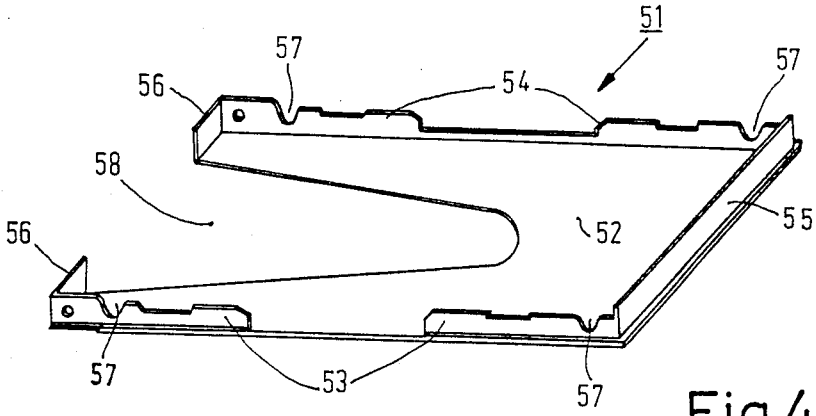

In the drawings:

FIG. 1 shows a machine comprising an apparatus for assembling a container or loading trays with discshaped information carriers, FIG. 2 shows a bottom section of a conventional container, FIG. 3 shows a tray adapted to receive a discshaped information carrier, and FIG. 4 shows an auxiliary bottom section for a machine in accordance with the invention.

A packaging machine 1 shown schematically in FIG. 1 and comprising an apparatus for assembly a container for optically readable disc-shaped information carriers normally serves to assemble a complete container for such an information carrier. The container, which is not shown in the Figure, normally comprises a bottom section, a cover section which is pivotally attached thereto, a bottom insert-card, a cover leaflet, and a tray into which a disc-shaped information carrier can be loaded. For this purpose the machine 1 shown in FIG. 1 comprises assembly stations 2 to 9. A rotatably supported turret 11 is provided with a total of eight holders 10 which are adapted to receive a bottom section for normal assembly of a container. As assembly proceeds the holders 10 are moved from station to station, so that the relevant assembly operation can be carried out at each of the stations 2 to 9. Devices with which the machine is equipped for this purpose are shown only schematically in FIG. 1.

By means of a feeder 21 a bottom section, to which a cover section is pivotally attached, is fed to the holder 10 at the assembly station 2. At the station 2 the bottom section is loaded into the holder10. In a manner not shown the holder 10 shown in FIG. 2 is constructed to firmly retain the bottom section. The bottom section, which has been loaded into a holder at the station 2, serves as an assembly base for the further stations. Subsequently, the turret 11 is advanced to the next station, so that the holder 10 is now moved from station 2 to station 3. At station 3 a bottom insert-card, not shown in FIG. 2, is inserted, which card has been fed to station 3 by a feeder 22, shown schematically in FIG. 1. After rotation of the turret 11 to the next station 4, a cover leaflet, not shown, is inserted into the cover section of the container by means of a manipulator 23, shown schematically in FIG. 1. At the next station 5 the cover section is closed by means of a suitable device 24. At the next station 6 a tray shown in FIG. 3 is loaded from a magazine, not shown, into the bottom section of the container by means of a feed manipulator or tray placing means 25. after rotation of the turret 11 to the station 7 a disc-shaped information carrier 26, shown schematically in FIG. 1, is loaded into the tray in which it is detachably retained. The disc-shaped information carrier is extracted from a box-shaped magazine 28 by means of a manipulator or carrier placing means 27, which magazine contains non-packaged disc-shaped information carriers arriving from the production line. At the next assembly station 8 the container is closed, that is, the cover section is swung down onto the bottom section. Now assembly of the container is completed and the container can be removed from the machine at the next station 9. For this purpose there is provided a manipulator or removing means at station 9 which grips the bottom section from underneath, lifts it out of the assembly station 9, and positions it on a conveyor 29, shown schematically. The package disc shaped information carriers can then be taken from this conveyor 29.

In accordance with the invention this machine, which normally serves for assembling a complete container, can also be used for loading disc-shaped information carriers into a tray without the tray and the information carrier being packaged in a complete container comprising a bottom section and cover section. For this purpose an auxiliary bottom section as shown in FIG. 4 is placed in each of the holders 10. The auxiliary bottom section is fixedly connected to the holder 10 and remains in this holder during assembly. In order to minimize the time required for conversion of the machine, it is advantageous to secure the auxiliary bottom sections detachably in the holders 10. This may be effected, for example by means of screws, by gluing etc. The turret 11 with the auxiliary bottom sections placed in the holders 10 now passes the assembly stations 2 to 5, but these stations are idle, that is, they receive no bottom cover sections and no insert cards. At station 6 a tray is inserted into the auxiliary bottom section in the customary way. This is possible because in principle the auxiliary bottom section has the same dimensions as a bottom section normally placed in the holder 10. Insertion of a disc-shaped information carrier 26 at the station 7 also proceeds in the same way. The station 8, where otherwise the cover is closed, also idles in the same way as the stations 2 to 5. At the station 9 the manipulator now solely grips the tray, lifts it out of the station 9, and places it on the conveyor 29. Only the tray is removed from the station 9, because the auxiliary bottom section is formed with an opening at the location where it is normally gripped by the manipulator, so that only the tray which is situated in the auxiliary bottom section and which detachably holds the disc-shaped information carrier is gripped and placed on the conveyor 29 by the manipulator.

In this way the machine 1 with the assembly apparatus, shown in FIG. 1 can be used both for completely assembling and loading a container with an information carrier and for loading trays with information carriers without the remainder of the container.

FIG. 2 shows a bottom sectin 31, as normally used for packaging Compact Discs. The bottom section is transparent and comprises a bottom panel, two transverse side walls 32 and 33 and two longitudinal side walls 34 and 35. In their centres and two longitudinal side walls 34 and 35 are each formed with a gripping recess 36. Near the transverse side wall 32 both longitudinal sidewalls 34 and 35 have bores 37 for pivotably attaching a cover section, not shown. The bottom section 31 further has two slightly smaller bores 38 in each of the two longitudinal side walls 34 and 35, of which one bore is situated at a predetermined distance from the transverse side wall 32 or the transverse side wall 33.

FIG. 3 shows a tray 41 situated in the bottom section 31 shown in FIG. 2. In its centre the tray 41 has a peg-shaped holder 42 which can detachably hold a disc-shaped information carrier. The tray 41 is latched in the bottom section 31. Latching is effected in such a way that latching noses of the tray 41 engage in the bores 38 in the bottom secton 31 in a manner, not shown. This ensures that the tray 41 is immobilized in the bottom section 31 in such a way that it cannot come loose during normal use of the container.

FIG. 4 shows an auxiliary bottom section 51 which in principle has the same dimensions as the container bottom section 31 shown in FIG. 2. The auxiliary bottom section 51 has a bottom 52, longitudinal side walls 53, 54 and transverse side walls 55 and 56. The basic dimensions are the same as those of the container bottom section 31 shown in FIG. 2. In particular the longitudinal and transverse side walls are arranged at equal distances from one another in the same way as the corresponding walls of the container bottom section 31. The two longitudinal side walls 53 and 54 of the auxiliary bottom section 51 have substantially the same shape as the longitudinal side walls 34 and 35 of the container bottom section 31. However, the longitudinal side walls 53 and 54 are provided with upwardly open recesses 57 at the same locations where the side walls 34 and 35 of the container bottom section 31 are formed with bores 38. The upwardly open recesses 57 thus prevent the latching noses of the tray 41, which otherwise engage in the bores 38 of the container bottom section 31, from engaging the auxiliary bottom section. This must be avoided to allow the trays 41 to be readily removed from the auxiliary bottom sections 51 when assembly is completed. The transverse side wall 56 and the bottom 52 of the auxiliary bottom section 51 are provided with an opening 58. This opening 58 may have different shapes, but in any case it must be dimensioned in such a way that a manipulator or similar device, which at the last assembly station normally removes the container bottom section, does not grip the auxiliary bottom section 52 but only a tray 41 placed in this bottom section. In the auxiliary bottom section shown in FIG. 4 the opening 58 in the bottom 52 has an elongate shape which widen towards the transverse side wall 56 which is interrupted at the same location.

The precise construction of the side walls of the auxiliary bottom section 51 shown in FIG. 4 is not relevant. It is important only that the tray is immobilized in the auxiliary bottom section, so that further assembly, in particular insertion of the disc-shaped information carrier into the tray, is possible in an accurately defined position of the tray. Further, the auxiliary bottom section must be constructed in such a way that the tray is easy to remove, that is that it is not clamped too firmly in the auxiliary bottom section.

An auxiliary bottom section as shown in FIG. 4 can be secured in various ways in the holders 10 of the machine shown in FIG. 1. Since in general the machine should also remain suitable for assembling a complete container after a minimal conversion time, it is advantageous to secure the auxiliary bottom sections 52 detachably in the holders 10 of the machine 1. This can be achieved, for example, by means of screws, but also by means of adhesives etc.

What is claimed is:

1. The combination of an adaptor and a machine having a plurality of stations and useful for assembling containers for optically readable disc-shaped information carriers, each container comprising a bottom section, a cover section which is pivotably attachable to said bottom section, a tray latched within its associated bottom section for detachably retaining thereon a disc-shaped information carrier when placed on said tray, said machine having holders for retaining bottom sections during assembly of containers, said holders being moveable from station to station by said machine during the assembly of containers, said adaptor comprising an auxiliary bottom section having substantially the same dimensions as a container bottom section, said auxiliary bottom section being carried by one of said holders, said machine including a tray placing means for placing a predetermined tray in said auxiliary bottom section, a disc-shaped information carrier placing means for placing a predetermined carrier on said predetermined tray and removing means for removing said predetermined tray and said predetermined carrier as a unit from said auxiliary bottom section.

2. A combination according to claim 1, wherein a plurality of auxiliary bottom sections are carried by a plurality of said holders.

3. A combination according to claim 2, wherein each said auxiliary bottom section has side walls, said side walls being provided with open recesses at locations corresponding to those where a tray is latched within an associated bottom section.

4. A combination according to claim 3, wherein each said auxiliary bottom section has a bottom panel and an aperture which is provided in said bottom panel and at least one side wall through which said removing means can remove an associated predetermined tray and predetermined carrier.

* * * * *